US007055361B2

(12) United States Patent
Hetland et al.

(10) Patent No.: US 7,055,361 B2
(45) Date of Patent: Jun. 6, 2006

(54) PLIERS-TYPE HANDTOOL HAVING A CRIMPING STATION

(75) Inventors: Detlev Hetland, Detmold (DE); Gunther Hanning, Detmold (DE); Hartmut Schmode, Blomberg (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 10/882,429

(22) Filed: Jul. 2, 2004

(65) Prior Publication Data

US 2005/0000266 A1 Jan. 6, 2005

(30) Foreign Application Priority Data

Jul. 5, 2003 (DE) ..... 203 10 378

(51) Int. Cl.
*H01R 43/045* (2006.01)

(52) U.S. Cl. ..... 72/409.06; 29/751; 29/816

(58) Field of Classification Search ..... 72/409.06, 72/409.04; 29/751, 816; 226/157, 153; 74/142

See application file for complete search history.

(56) References Cited

U.S. PATENT DOCUMENTS

| | | | | |
|---|---|---|---|---|
| 3,075,198 | A * | 1/1963 | Over | 72/409.06 |
| 3,911,712 | A * | 10/1975 | Wustinger et al. | 72/324 |
| 4,022,051 | A * | 5/1977 | Ichikawa | 72/409.06 |
| 5,347,705 | A * | 9/1994 | Schmode et al. | 29/566.4 |
| 5,500,998 | A * | 3/1996 | Schmode et al. | 29/751 |

FOREIGN PATENT DOCUMENTS

| | | |
|---|---|---|
| DE | 41 36 302 C1 | 3/1993 |
| DE | 4 322 856 C1 | 6/1994 |
| EP | 05 62 229 B1 | 12/1999 |

* cited by examiner

*Primary Examiner*—Daniel C. Crane
(74) *Attorney, Agent, or Firm*—Lawrence E. Laubscher, Sr.; Lawrence E. Laubscher, Jr.

(57) ABSTRACT

A pliers-type handtool is provided for crimping an electrical connector upon one end of an insulated conductor, including a crimping drum that is mounted on a fixed member for rotation between first and second positions, and an actuating lever that is reciprocated by pivotal movement of the handle portions of the handtool to rotate the drum between its first and second positions. The actuating lever is connected with the drum by a lateral slot of divergent width that receives a drum pin that extends axially from one end of the drum, the slot having a width adjacent its bottom that corresponds generally with the diameter of the drum pin.

3 Claims, 3 Drawing Sheets

PLIERS-TYPE HANDTOOL HAVING A CRIMPING STATION

BACKGROUND OF THE INVENTION

1. Field of the Invention

A pliers-type handtool includes a fixed and movable handle members connected intermediate their ends for pivotal movement between open and closed positions, thereby to rotate a crimping drum mounted on the fixed handle member from a first position to a second position. To improve the operation of the mechanism and eliminate the jamming thereof, the actuating lever that is pivotally connected at one end with the movable member contains at its other end a divergent lateral slot that receives the crimping drum pin that extends axially from the drum eccentrically relative to the axis thereof.

2. Description of the Related Art

This invention is an improvement over the hand-held crimping tool disclosed inn the Applicant's prior European patent No. EP 0562,229, the disclosure of which is hereby incorporated by reference. In this prior patent, the pliers-type crimping tool includes a supply magazine that supplies a plurality of electrical connectors that are to be connected by crimping to the ends of insulated electrical conductors. The connectors are transported in succession from the supply magazine toward a crimping position by means of a rotary drum that is carried by the fixed handle member.

This known crimping apparatus is relatively complex in construction and requires a large number of precisely machined parts to achieve efficient operation. One drawback to the known machines is their tendency to jam during use. In the known device, an actuating lever is used to connect the movable handle with the crimping drum, use being made of a lateral slot contained in the actuating lever and having parallel side walls, the clearance of the slot throughout its length corresponds with the diameter of the drum pin that extends axially from the crimping drum into the slot contained in the actuating lever.

In practice, this can result in the following undesirable situation. In an attempt to link the drum piece to the transport lever by inserting the drum pin into the slot, there can be a certain kind of interference because the exact position of the slot with relation to the drum pin in the final analysis cannot be achieved with the desired precision by means of tolerances in the remaining complete system.

The present invention was developed to improve handtools of the type involved here that it will be possible to introduce a drum pin into the slot of the actuating lever without any difficulty under all circumstances.

BRIEF SUMMARY OF THE INVENTION

Accordingly, a primary object of the present invention is to provide an improved pliers-type handheld crimping tool in which the reciprocatory actuating lever that rotatably drives the crimping drum between first and second positions is provided with a lateral slot that is divergent for receiving the eccentrically arranged drum drive pin that extends axially from the crimping drum.

According to a more specific object of the invention, the actuating lever that rotatably drives the drum is pivotally connected to one end to the movable handle member and is guided by an inclined guide surface on an abutment provided on the fixed handle member to pivot the lever toward the drum, thereby to cause the drum pin to travel downwardly in the slot contained in the lever.

In this way, one can make sure that the drum pin will reside in a position with relation to the actuating lever immediately after insertion into the slot within the widened area of the slot in which one has achieved an almost play-free coupling between the drum pin, on the one hand, and the actuating lever, on the other hand. The longitudinal shifting of the actuating lever is thus reliably transmitted to the crimping drum in a corresponding rotation angle area.

A slight forward movement of the transport lever thus results in pivotal movement of the actuating lever in the direction of the drum pin so that even after a minimum of shifting path distance of the actuating lever, one can ensure optimum coupling between the actuating lever and the drum pin, and thus the crimping drum.

According to a further object of the invention, the lateral slot contained in the actuating lever is outwardly divergent so that the width at the bottom of the slot corresponds generally with the diameter of the drum drive pin, and the width at the top of the slot is greater than the diameter of the drum pin.

Because of the widened area of the slot, it becomes considerably easier to insert or connect the drum pin into that slot, and even in case of relatively large tolerances within the overall system of the handtool, one can thus always link the drum pin into the slot of the actuating lever without trouble.

According to an advantageous development of the invention, it is provided that the actuating lever upon activation of the handles will be pivoted in the direction of the drum pin so that the drum pin will engage in an area of the slot that corresponds to its diameter.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1:
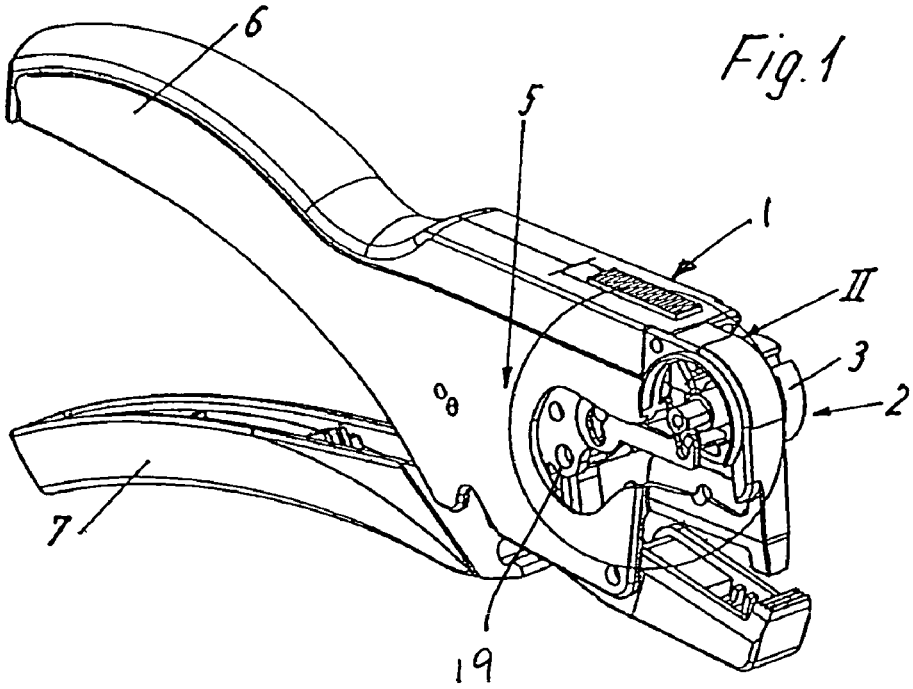
FIG. 1 is a front perspective view of the crimping tool of the present invention.
Figure 2:
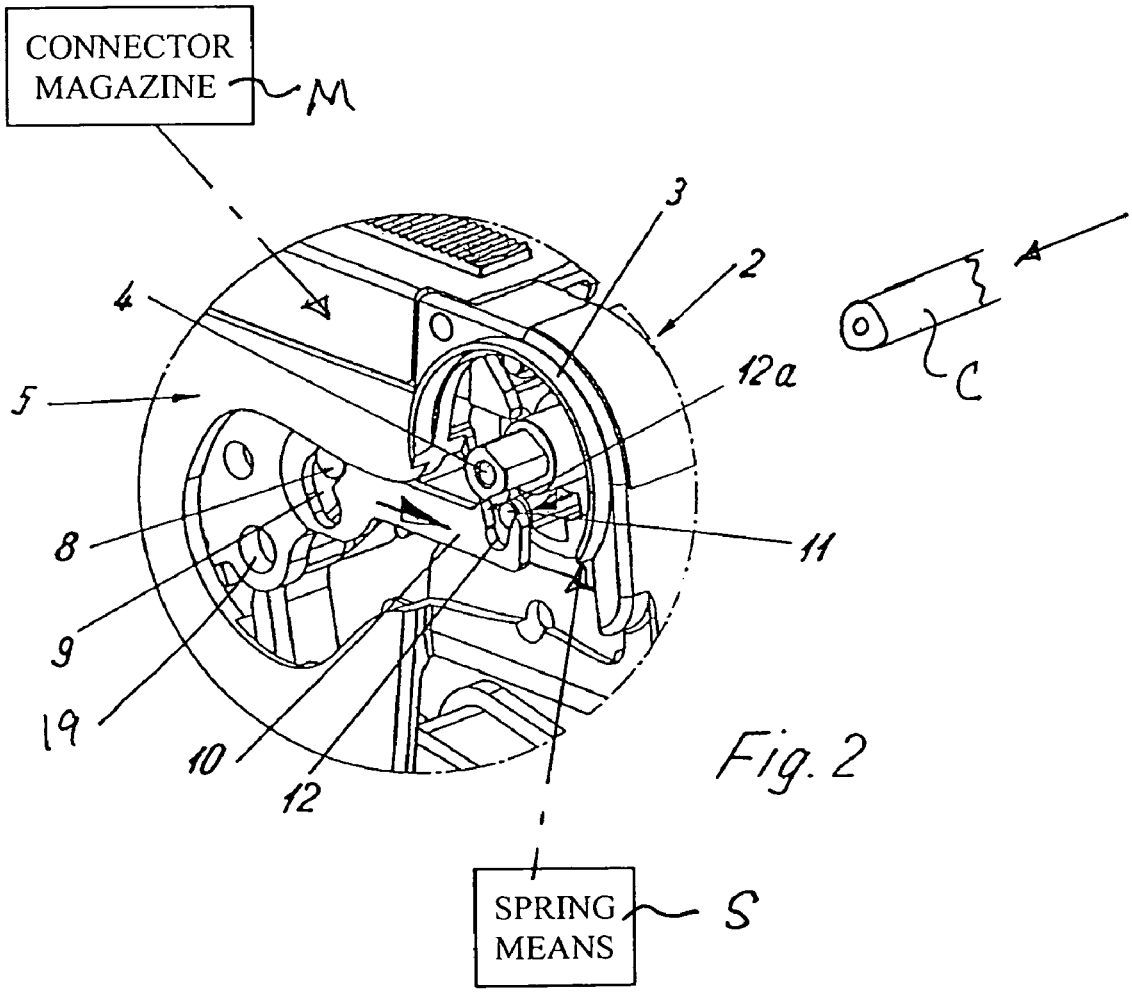
FIG. 2 is an enlarged detailed view of the circled portion of FIG. 1.

Referring first more particularly to FIGS. 1 and 2, the handheld crimping tool 1 includes a crimping station 2 including a crimping drum 3 that is mounted for rotation about a shaft 4 that is mounted within the housing 5 of the fixed handle member 6. The movable handle member 7 and the fixed handle member 6 are pivotally connected intermediate their ends for pivotal movement about a pivot axis 19. The crimping drum 3 is mounted for axial displacement on the support shaft 4 between a retracted first position illustrated in FIG. 2, and an extended position illustrated in FIGS. 4 and 6. The crimping drum is normally spring biased by spring means S toward its retracted first posistion and may be axially displaced toward its extended position by an insulated conductor C. An actuating lever 10 is pivotally connected at one end with a drive pin 8 carried by the movable handle member 7, the drive pin 8 extending through a hole 9 contained in the adjacent end of the actuating lever. The other end of the actuating lever 10 contains a lateral slot 12 that is adapted to receive a drum pin 11 that extends axially from the crimping drum 3 in radially-spaced eccentric relation to the support shaft 4. As will be explained in greater detail below, when then the actuating lever 10 is displaced by the drive pin 8 to the right as shown by the arrow in FIG. 2, an electrical connector from the magazine M contained within the housing 5 is transported by the crimping drum 3 toward the crimping means (not shown).

Figure 3:
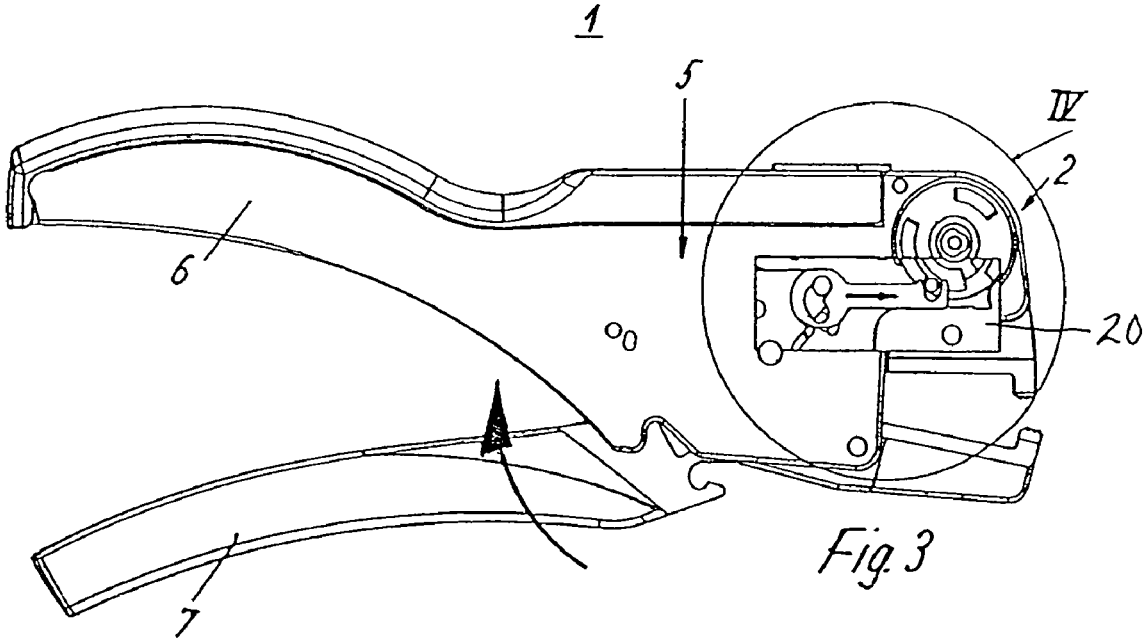
FIG. 3 is a side elevation of the tool when in the open condition.
Figure 4:
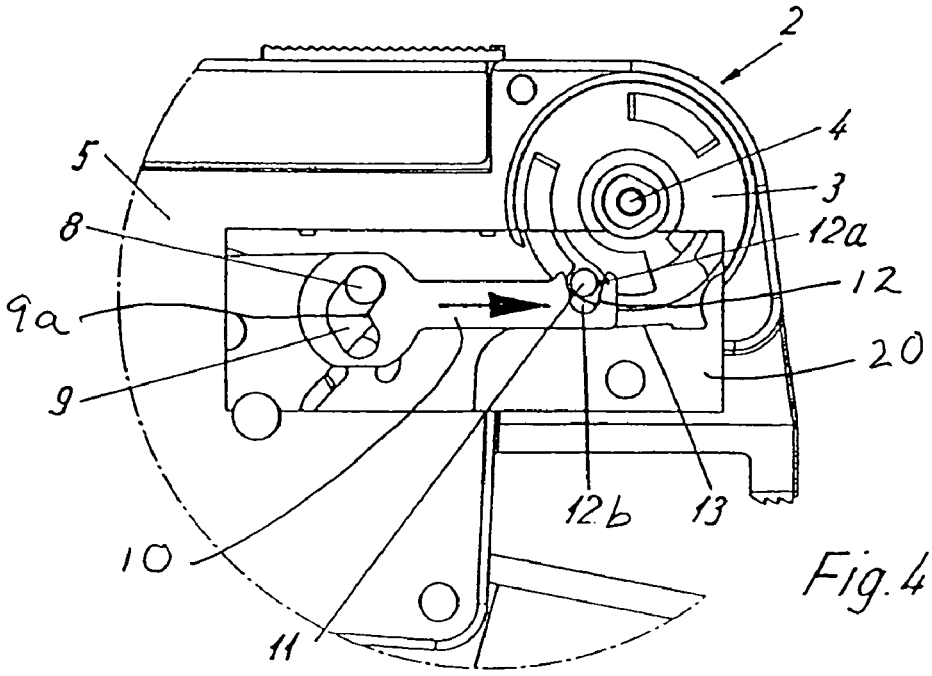
FIG. 4 is an enlarged detailed view of the circled portion of FIG. 3.

Referring now to FIGS. 3 and 4, the drive pin 8 on the movable handle member 7 extends through an opening 9 having a cam surface 9*a*. Initially, the drive pin 8 is received in the upper portion of the cam opening 9, and the right hand end of the lever 10 is supported by an inclined surface 13 carried by the fixed abutment 20 which is secured to the fixed handle member 6. Assuming that the crimping drum has been axially displaced toward its extended position by the insulated conductor C, the drum pin 11 is positioned opposite the entrance portion 12*a* of the lateral slot 12.

Figure 5:
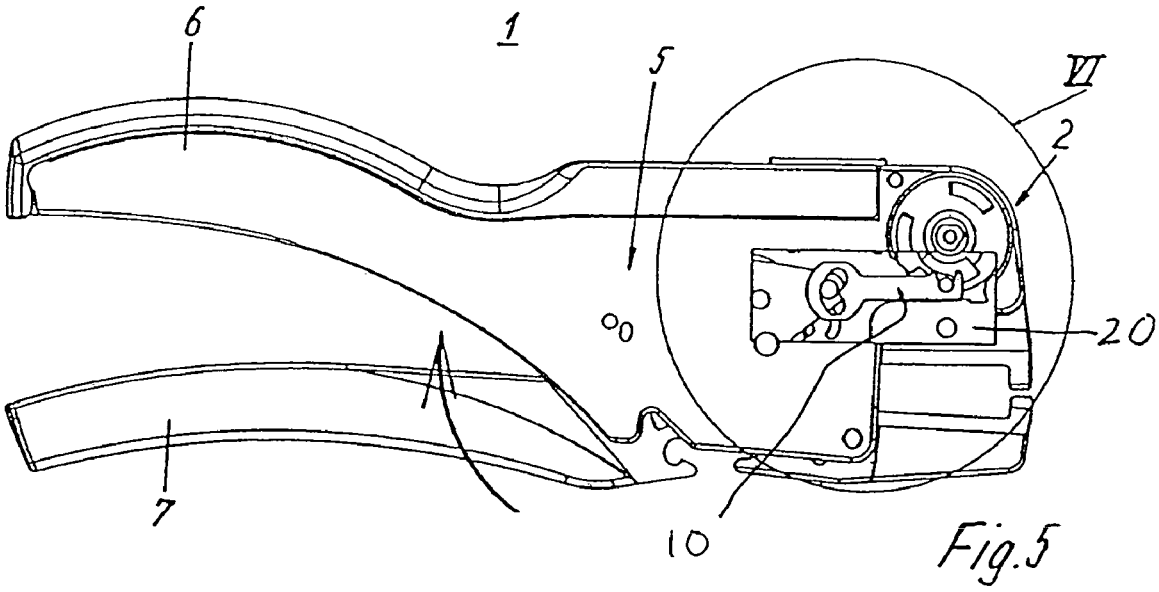
FIG. 5 is a side elevation view of the tool when in the closed condition.
Figure 6:
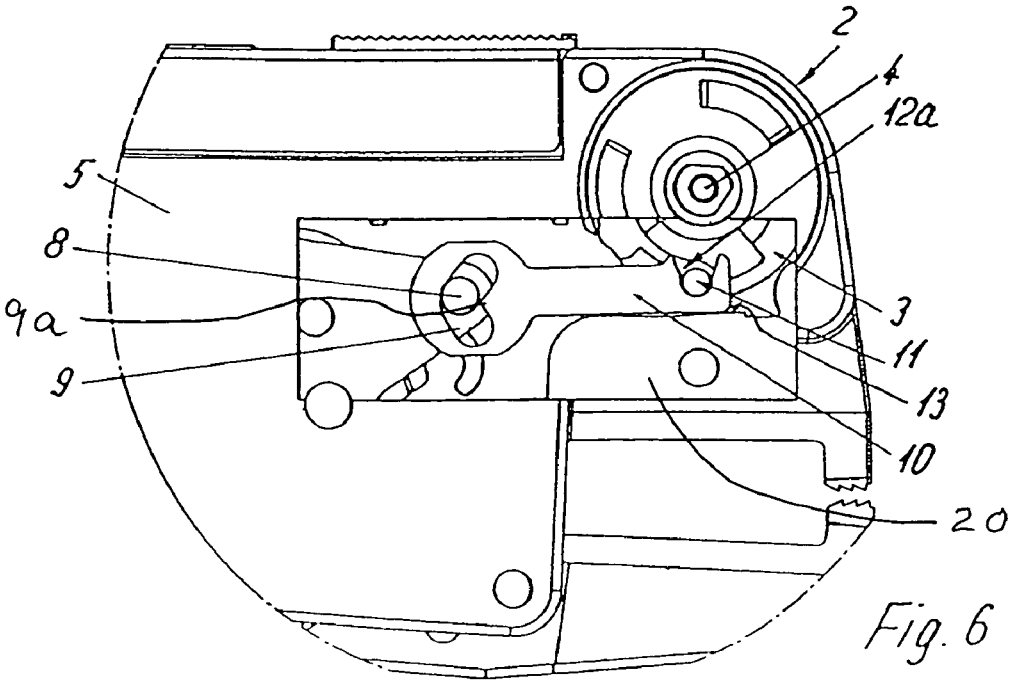
FIG. 6 is an enlarged detailed view of the circled portion of FIG. 5.

As the movable handle member 7 is pivoted toward its closed position shown in FIG. 5, the drive pin 8 slides down upon the cam surface 9*a* of the opening 9, thereby displacing the actuating lever 10 to the right, whereby the crimping drum is rotated from its initial connector-receiving first position toward its connector delivering second position, as best shown in FIG. 6. During this displacement of the lever 10 to the right, the right hand end thereof rides upon the inclined surface 13 of the fixed abutment 20, thereby to cause the drum pin 13 to be displaced downwardly within the slot 12 toward the bottom portion 12*b* thereof. The width of the slot 12 adjacent the bottom 12*b* is generally equal to the diameter of the drum pin 13, thereby to accurately and precisely connect the actuating lever 10 with the drum pin 11. Upon release of the movable handle member 7, it is spring biased toward its open position relative to the fixed handle member 6, thereby retracting the actuating lever 10 toward its initial position of FIG. 4, whereby the crimping drum is returned to its initial first position.

The drum pin 11 is preferably provided with an enlarged head portion that prevents axial displacement of the crimping drum 3 from its extended position toward its initial retracted position. After the completion of a working cycle, the actuating lever 10 is displaced to the left, and the locking of the crimping drum 3 by the pin is released, thereby to permit the crimping drum to be spring-biased again toward its initial retracted position.

It is important to note that as a consequence of the divergent side walls of the lateral slot 12, the lower area 12*b* of slot 12 corresponding to the diameter of drum pin 11 is moved into a position where it rests against drum pin 11 so that one can now achieve a practically play-free coupling between the mentioned drum pin 11 and the slot 12 of the actuating lever 10.

As a result of this design, one can, on the one hand, make the insertion of drum pin 11 into the upper area 12*a* of slot 12 in a simpler and more reliable fashion, but at the same time, one can also make sure that the effectively usable shifting path of actuating lever 10 will be converted into an exactly defined rotational angle movement of the crimping drum 3.

As a result, one can simplify the activation or use of the crimping station 2 on the whole and one can reliably prevent jamming during the insertion of drum pin 11 into slot 12 also in case of unavoidable tolerances within the entire system as a whole.

The attainment of this objective is the purpose of the invention at hand. A more detailed description of the crimping drum and its general control at this point is presented by European patent No. EP 0 652 229 B1, which describes in detail the entire rather complicated structure of the crimping drum and its overall control and the way it works. The corresponding description parts to that extent are expressly made as part of the application at hand.

As is described in the previously mentioned European patent, a crimping drum 3, as a rule, advantageously has several stages for the purpose of processing differently dimensioned electrical conductors. This means that the crimping drum 3 can be rotated into various usable working positions. Correspondingly, a crimping drum 3 is then equipped on its front facing toward transport lever 10 also with a plurality drum pins 11 in order reliably to drive the crimping drum in each working position assumed.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A pliers-type crimping handtool for crimping an electrical connector onto an insulated conductor, comprising:

(a) a fixed member including a housing (5) having a first end defining a fixed handle portion (6);

(b) a movable member including a first end defining a movable handle portion (7), said fixed and movable members having second ends, said members being pivotally connected intermediate their ends for relative displacement about a pivot axis between open and closed conditions;

(c) a crimping drum (3) connected with said fixed member second end for rotation about an axis (4) parallel with said pivot axis between first and second positions, said crimping drum being operable to transport an electrical connector from said first position to said second position; and (d) rotating means for rotating said crimping drum from said first position toward said second position as said fixed and movable members are pivoted from said open condition toward said closed condition, said rotating means including:

(1) a drum pin (11) extending axially from one end of said drum parallel with and radially spaced from said drum axis;

(2) an actuating transport lever (10) connected with said movable member for reciprocatory movement in a plane normal to said drum axis, said actuating lever having a first end pivotally connected with said movable member, and a second end containing a slot (12) opposite and extending normal to said drum pin, said slot including a bottom portion (12*b*) having a width that corresponds generally with the diameter of said drum pin, said slot including a divergent top portion (12*a*) having a width that is greater than the diameter of said drum pin; and (3) means for pivoting said actuating lever about said first end to cause said drum pin to be displaced laterally downwardly toward the bottom of said slot as said fixed and movable members are pivoted from said open condition toward said closed condition, said lever pivoting means including:

(a) fixed abutment (20) carried by said fixed member adjacent said actuating lever second end on the opposite side thereof from said crimping drum, (b) said abutment including an inclined guide surface (13) that is operable during displacement of said first and second members toward the closed condition to pivot said actuating lever in a direction causing relative lateral displacement of said drum pin downwardly into said slot.

2. A crimping tool as defined in claim 1, wherein said movable member is connected with said actuating lever by means of a drive pin (8) that extends laterally from said movable member second end into an elongated cam slot (9) contained in said actuating lever first end, said cam slot having a cam surface (9*a*) that is operable to displace said actuating lever generally in the direction of said drum as said fixed and movable members are displaced toward the closed condition.

3. A crimping tool is defined in claim 1, wherein said fixed member contains a drum support shaft defining said drum axis and upon which said crimping drum is rotatably mounted, said crimping drum being axially displaceable on said shaft between a retracted position in which said drum pin is spaced from said actuating lever, and an active position in which said drum pin is adjacent said actuating lever, said crimping drum being normally spring biased toward said inactive position and being axially displaceable by an insulated conductor toward said active position.

* * * * *